US005960893A

United States Patent [19]

Prokop et al.

[11] Patent Number: 5,960,893

[45] Date of Patent: Oct. 5, 1999

[54] FLUID-POWERED PERCUSSION TOOL

[75] Inventors: Heinz-Jürgen Prokop; Marcus Geimer, both of Essen, Germany

[73] Assignee: Krupp Bautechnik GmbH, Germany

[21] Appl. No.: 08/990,465

[22] Filed: Dec. 15, 1997

[30] Foreign Application Priority Data

Dec. 14, 1996 [DE] Germany ..... 196 52 079

[51] Int. Cl.[6] ..... B25D 9/04

[52] U.S. Cl. ..... 173/206; 173/137; 173/138

[58] Field of Search ..... 173/206, 208, 173/207, DIG. 2, 135, 137, 138; 91/303, 290, 276

[56] References Cited

U.S. PATENT DOCUMENTS

| | | | |
|---|---|---|---|
| 3,965,799 | 6/1976 | Juvonen et al. | 91/321 |
| 4,084,486 | 4/1978 | Juvonen . | |
| 4,355,691 | 10/1982 | Karru et al. . | |
| 4,474,248 | 10/1984 | Musso | 173/208 |
| 4,635,531 | 1/1987 | Rode . | |
| 4,646,854 | 3/1987 | Arndt et al. . | |
| 4,852,663 | 8/1989 | Hunt | 173/208 |
| 5,022,469 | 6/1991 | Westerberg | 173/DIG. 2 |
| 5,056,606 | 10/1991 | Barthomeuf | 173/208 |
| 5,279,120 | 1/1994 | Sasaki | 173/208 |
| 5,392,865 | 2/1995 | Piras | 173/208 |
| 5,477,932 | 12/1995 | Asakura | 173/206 |
| 5,520,254 | 5/1996 | Weber | 173/206 |
| 5,718,297 | 2/1998 | Weber | 173/206 |

FOREIGN PATENT DOCUMENTS

| | | |
|---|---|---|
| A1 0 149 967 | 11/1984 | European Pat. Off. . |
| PS 551138 | 5/1932 | Germany . |
| 3023600 C2 | 6/1980 | Germany . |
| 3400302 A1 | 1/1984 | Germany . |
| 3443542 C2 | 11/1984 | Germany . |
| 4131070 C2 | 9/1991 | Germany . |

*Primary Examiner*—Peter Vo
*Assistant Examiner*—James P. Calve
*Attorney, Agent, or Firm*—Venable; George H. Spencer; Robert Kinberg

[57] ABSTRACT

A fluid-powered percussion tool includes a percussion piston which, under the effect of a control alternately performs a working stroke and a return stroke with the aid of a control valve. The control valve assumes a working stroke or a return stroke position, depending on the position of the percussion piston. In the working stroke position, the percussion piston is admitted with working pressure such that it performs a working stroke counter to the effect of a continuous reset force. In contrast, the percussion piston is connected in the return stroke position to a discharge line so that it performs a return stroke under the effect of the reset force. The control valve is admitted during the working stroke with working pressure and is thereby held in the working stroke position. With the approach of the percussion piston to the point of impact, the connection to the pressure line under working pressure is interrupted and only a low pressure level is maintained in the region of control valve, under the effect of which the control valve is switched to the return stroke position and kept in this position during the return stroke.

10 Claims, 4 Drawing Sheets

FLUID-POWERED PERCUSSION TOOL

CROSS-REFERENCE TO RELATED APPLICATIONS

This application claims the right of priority of German application 196 52 079.7, filed in Germany on Dec. 14, 1996, the disclosure of which is incorporated herein by reference.

BACKGROUND OF THE INVENTION

The invention concerns a fluid-powered percussion tool with a percussion piston movable within a working cylinder and impacting with a tool, as well as a control, comprising a control valve that moves relative to a housing, wherein the percussion piston has two piston areas of variable size, of which the smaller piston area that is effective in the direction of the return stroke is constantly connected to a pressure line under operating pressure and the larger piston area that is effective in the direction of the working stroke is connected via the control alternately to the pressure line and a discharge line. The control valve comprises two valve faces effective in opposite direction, which are designed and admitted with pressure, such that the control valve switches to the working stroke position when the percussion piston approaches the upper dead point during the return stroke, in which position the operating pressure is also present at the larger piston area, and that the control valve changes to the return stroke position when the percussion piston approaches the point of impact during the working stroke, in which position the admitting of the larger piston area with operating pressure is interrupted and a connection is established with the discharge line.

A fluid-powered percussion tool of the aforementioned type is disclosed in the German patent document DE-C2-34 43 542. The control valve of the known device has two valve faces of different size that are effective in opposite movement direction, of which the smaller valve face that affects the control valve in the return stroke position is constantly connected to the pressure line and of which the larger valve face is connected in each case as a control surface via a control line and a circumferential groove between the piston areas, but only at times as well as alternately with the pressure line or an non-pressurized return line.

The use of a special holding or shuttle valve, which is installed in the control line that operates jointly with the control and which is alternately also connected to the return line, is designed to ensure that even with a reflection of impact energy via the tool onto the percussion piston, this reflected energy is recovered hydraulically, thereby resulting in an increase in the number of impacts for the percussion piston. The control itself is arranged separate from the working cylinder holding the percussion piston.

A hydraulically operated percussion tool with a percussion piston is also known from European patent document EP-A1-0 149 967, where a hydraulic reset force is also effective in the direction of the return stroke by way of a smaller piston area. The associated control, which is integrated into the working cylinder holding the percussion piston, has a control valve in the form of a sleeve-type switching element. This control valve encloses with a clearance the percussion piston in the region of the rear cylinder chamber segment, which can be used to admit a larger piston area that is effective in the direction of the working stroke with working pressure. For this known embodiment, the control valve is moved mechanically, by means of the percussion piston from the return stroke to the working stroke position. Accordingly, the hammer-piston stroke cannot be changed.

In contrast to the last-mentioned document, German patent document DE-C2-30 23 600 describes a hydraulic impact rotary drilling machine with a sleeve-type control valve design, which is controlled hydraulically via the percussion piston and is supported movably on the percussion piston as well as on the inside of the working cylinder. This known impact rotary drilling machine has the disadvantage of requiring a double fitting in the control valve region, meaning the control valve must have very little play in the outside and inside diameter region to ensure a perfect operation.

SUMMARY OF THE INVENTION

It is an object of the invention to develop a fluid-powered percussion tool with a different design for the control. In particular, the control is to be designed so that it can operate without being continuously admitted with high pressure (meaning with the working pressure necessary for the percussion tool operation) and without being admitted with a mechanical force, in particular also through the percussion piston.

The above and other objects are accomplished according to the invention by the provision of a fluid-powered percussion tool, comprising: a working cylinder having a front cylinder chamber segment and a rear cylinder chamber segment; a percussion piston having opposite ends and movable within the working cylinder in one direction during a working stroke for impacting a tool at one of the ends and movable in an opposite direction during a return stroke, the percussion piston including a first piston area effective in the return stroke direction, delimiting the front cylinder chamber segment and being constantly connected to a pressure, the percussion piston further including a second piston area, larger than the first piston area, effective in the working stroke direction and delimiting the rear cylinder chamber segment, the percussion piston further including a circumferential groove arranged between the first and second piston areas and being connected to a non-pressurized return line; a control housing; and a control valve disposed within the control housing and movable relative to the housing between a working stroke position and a return stroke position, the control valve comprising a sleeve defining an interior hollow space which is in communication with the rear cylinder chamber segment, the control valve presenting valve faces of different sizes that are effective in opposite directions to each other and a control surface which is effective in a direction of the working stroke position of the control valve and which is alternately coupled by a line to (a) the circumferential groove between the first and second piston areas of the percussion piston for communicating with the return line and (b) to the front cylinder chamber segment for communicating with the pressure line, the rear cylinder chamber segment being placed in communication with one of the pressure line and the return line in dependence of the position of the control valve, a difference in the sizes of the valve faces of the control valve presenting a total effective surface which is under a changeable pressure proportional to the pressure on the larger second piston area delimiting the rear cylinder chamber segment, wherein when the percussion piston approaches an upper dead center position during the return stroke, the control surface of the control valve is connected to the pressure line via the front cylinder chamber segment and switches into the working stroke position for connecting the rear cylinder chamber segment with the pressure line, and when the percussion piston approaches a point of impact during the working stroke, the control surface of the control valve is coupled to the return line via the circumferential groove of the percussion piston to relieve pressure at the control surface and the control valve is switched to the return stroke position due to the pressure in the rear cylinder chamber segment, interrupting the connection of the rear cylinder chamber segment with the pressure line and connecting the rear cylinder chamber segment with a discharge line, which is connected to the return line via a flow resistance for discharging the rear cylinder segment against the flow resistance.

Based on this, the control valve has a control surface that is effective in the direction of the working stroke position, which, depending on the position of the percussion piston, is at times connected via a circumferential groove arranged between the piston areas to an non-pressurized return line or to the pressure line. The control valve is additionally provided with a total effective operating surface (formed by the difference between the control valve faces), which switches the control valve to the return stroke position, with a pressure-relieved control surface during the return stroke, under a variable pressure that is proportional to the pressure on the larger piston area. The control valve is a sleeve-type switching element with a hollow space, designed to connect the cylinder chamber segment containing the larger piston area either to the discharge line in the return stroke position or to the pressure line in the working stroke position, wherein during the return stroke position, the fluid is discharged counter to a flow resistance from the rear cylinder chamber segment (into the previously mentioned it) discharge line). In this case, the flow resistance functions to generate and maintain during the return stroke a sufficient pressure level in the rear cylinder chamber segment, which pressure level acts upon the total effective surface of the control valve and results in an adjustment force that is effective in the direction of the return stroke position.

A mechanical reset can additionally be provided to support the variably control force when switching the control valve to the return stroke position. This reset consists in the most simple case of a spring unit.

For a modification of the subject-matter of the invention, the control surface of the control valve, as seen in the cross section, is designed with a shoulder that projects radially outward like a collar, for which the counter surface is maintained without pressure by way of a relief line.

Within the framework of the invention, the control valve has two faces of varying size, for which the larger face is effective in a direction counter to the control surface.

The control valve must generally be arranged and designed such that in the return stroke position a connection between the rear cylinder chamber segment and the discharge line is freed, e.g. through an offset or a recess. In particular, the control valve can be designed such that the connection to the discharge line is made via a cross bore in the control valve.

Within the framework of the invention, the flow resistance can be arranged either in the cross bore itself or in the discharge line. The cross bore is preferably arranged adjacent to the larger face.

The control valve can furthermore be arranged so that is during the return stroke position of the control valve, a ring-groove shaped mouth of the pressure line is closed off in the direction of the rear cylinder chamber segment by a portion of the control valve, which ends at the smaller control valve face.

Within the framework of the invention, the control can basically be arranged separate from the working cylinder. However, it is also possible to integrate the control into the working cylinder. For such an advantageous embodiment, the control valve is arranged in the rear cylinder chamber segment, coaxial to the longitudinal axis of the working cylinder.

In particular, the flow resistance can be designed as a screen, which operates essentially independent of the viscosity.

The subject-matter of the invention above all differs from the known state of the technology in that the control valve is only at times admitted with working pressure via its control surface, in which case the working pressure is also present in the hollow space of the control valve in the working stroke position. For a switching of the control valve to the return stroke position and to maintain this end position, only a low pressure level is maintained via the flow resistance. In that case, the fluid surrounding the control valve represents a drive means, which acts upon the control valve to move it to the return stroke position and hold it there, as long as its control surface is not admitted with working pressure.

In the following, the invention is explained in detail with the aid of embodiments shown in the drawing as highly diagrammatic views. Shown are in:

DETAILED DESCRIPTION OF THE INVENTION

Figure 1:
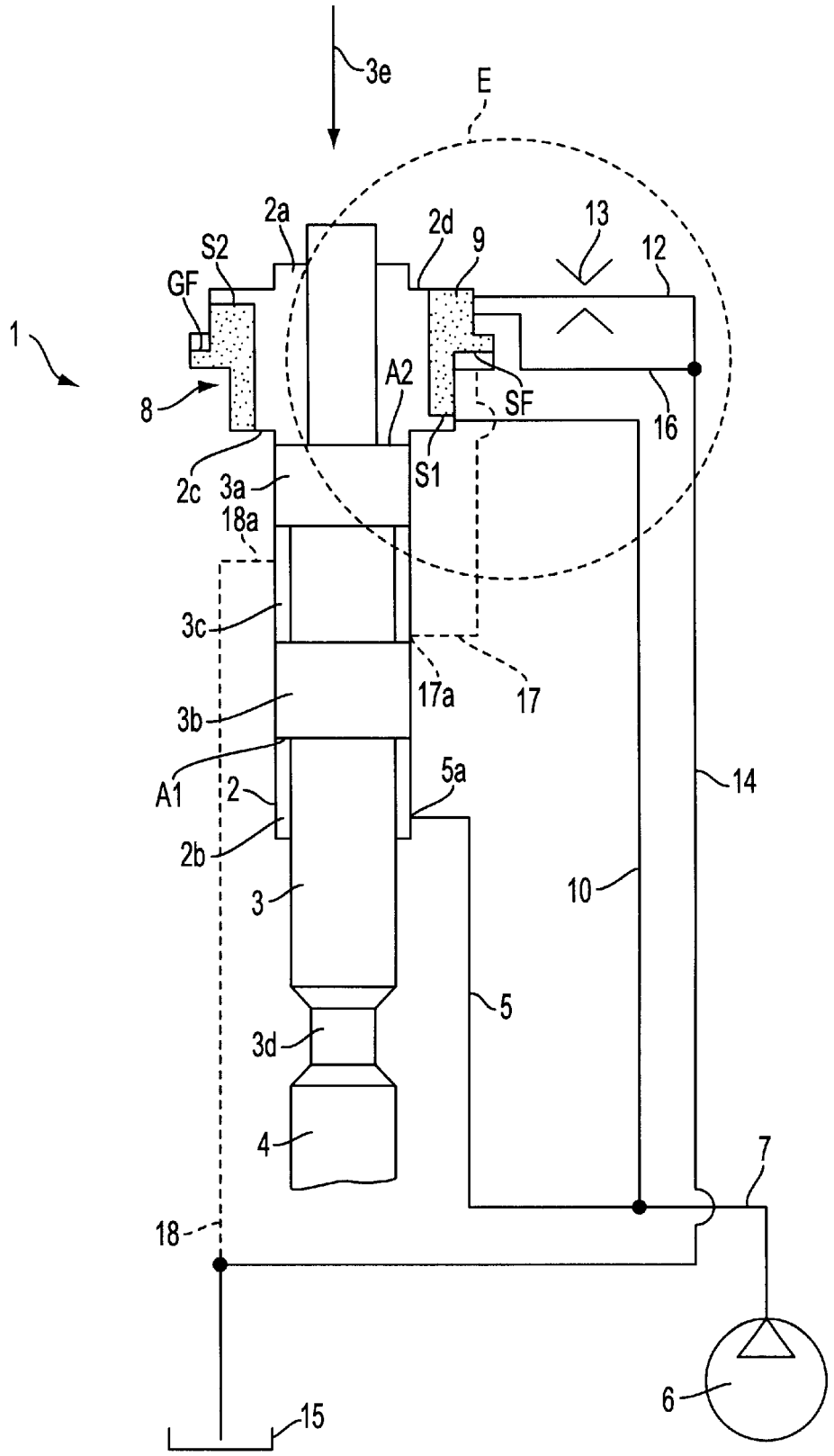
FIG. 1 is a schematic showing a partial side view of a percussion tool according to the invention, comprising a control for which the control valve is integrated into the working cylinder holding the percussion piston, wherein the control valve assumes the return stroke position on the left side of the illustration and the working stroke position on the right side.

Referring to FIG. 1, there is shown a percussion tool 1 comprising a working cylinder 2 with a percussion piston 3 held therein, such that it moves back and forth in a longitudinal direction. Percussion piston 3 has two piston collars 3*a* and 3*b*, which are arranged in the cylinder chamber of working cylinder 2 and are separated by a circumferential groove 3*c*. Percussion piston 3 includes spaced apart piston collars 3*b* or 3*a* which present outward-facing piston areas A1 and A2, which together with working cylinder 2, limit a rear and a front cylinder chamber segment 2*a* and 2*b*, respectively, wherein piston area A1 is dimensioned smaller than piston area A2. Outside of working cylinder 2, percussion piston 3 changes over to a piston tip 3*d*, which is located opposite a tool in the form of a chisel 4. The movement of percussion piston 3 in the direction of the working stroke is indicated by an arrow 3*e*. FIG. 1 shows percussion tool 1 in a state immediately after percussion piston 3 impacts with chisel 4. The percussion piston thus assumes the predetermined impact position.

In contrast to larger piston area A2, smaller piston area A1 is constantly admitted with the working pressure (system pressure) via a reset line 5. This pressure is generated by an energy source in the form of a hydraulic pump 6, via a pressure line 7 which connected to reset line 5. Reset line 5 has a mouth 5*a* which is arranged with respect to working cylinder 2 so that it is always positioned outside of piston collar 3*b* and thus within front cylinder chamber segment 2*b*.

Figure 2A:
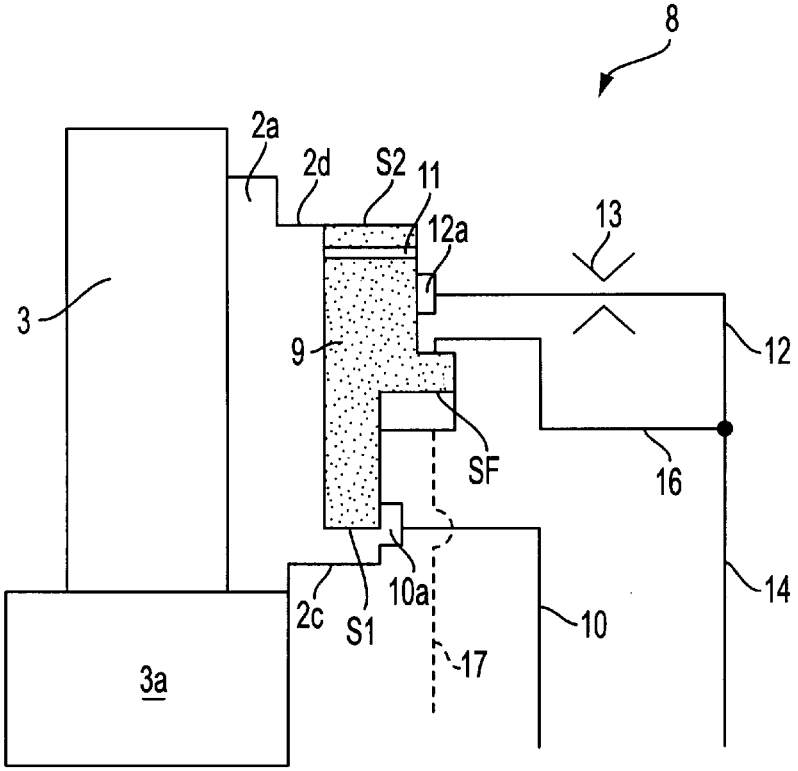
FIG. 2*a* is an enlarged illustration of the control region in the circle E in FIG. 1, wherein the associated control valve assumes the working stroke position.
Figure 2B:
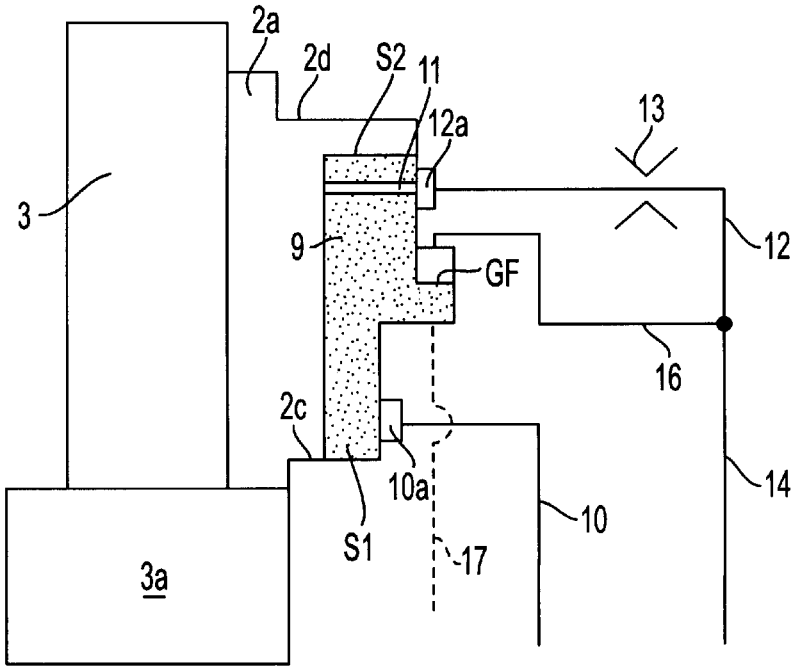
FIG. 2*b* is an enlarged illustration corresponding to FIG. 2*a*, wherein the control valve assumes the return stroke position.

Referring additionally to FIGS. 2*a*, 2*b*, a control 8 for switching the movement of percussion piston 3 is, according to this embodiment of the invention, integrated into working cylinder 2, meaning it is located in the region of rear cylinder chamber segment 2*a*, inside working cylinder 2. Control 8 has a control valve 9 that can be moved relative to a housing, wherein the housing in this embodiment is formed by a portion of working cylinder 2. Control valve 9 has a sleeve-type design and is arranged such that while positioned coaxial to percussion piston 3, it encloses the percussion piston with a clearance in the rear cylinder chamber segment 2*a*. Accordingly, an inside hollow space of control valve 9 simultaneously represents a portion of rear cylinder chamber segment 2*a*.

Control valve 9 itself has two faces of varying size, namely a smaller front face S1 and a larger rear face S2. The two mentioned faces S1 and S2 limit the axial movement range for control valve 9 in the direction of the working stroke (arrow 3*e*) or in the direction of the return stroke. Accordingly, control valve 9 can occupy two end positions, namely a return stroke position indicated on the top left in FIG. 1 and in FIG. 2*b*, in which control valve 9 supports itself via the smaller face S1 on a front stop face 2*c* of the working cylinder, and a working stroke position indicated on the top right in FIG. 1 and in FIG. 2*a*, in which the larger face S2 fits flush against a rear stop face 2*d*.

Located near the front stop face 2*c* of working cylinder 2 is a ring-groove shaped mouth 10*a* (FIG. 2*b*) for a supply line 10, which itself is connected to pressure line 7 and is constantly admitted with working pressure via this line. Control valve 9 has a cross bore 11 near its larger front face S2, which can also be used, if necessary, meaning in dependence on the position of control valve 9, to establish a connection between rear cylinder chamber segment 2*a* and a discharge line 12. The latter is provided with a flow resistance in the form of a screen 13 and changes over to a ring-groove shaped mouth 12*a* in the direction of control valve 9. Discharge line 12 is connected to a tank 15 via a non-pressurized return line 14.

As seen in axial direction, control valve 9 is also provided with a control surface SF in the region between the two frontal faces S1 and S2, which is effective in the direction of the working stroke position for control valve 9 and is designed as a shoulder that projects radially outward is like a collar, as seen in the cross section, and which has an opposite-positioned counter surface GF. The latter is relieved from pressure via a relief line 16 that is connected to the return line 14.

Control surface SF of control valve 9 can be admitted with the working pressure or can be relieved of pressure via a control line 17, which is connected to the inside space of the working cylinder 2 in a region between mouths 10*a* and 5*a*. In addition, working cylinder 2 is connected to tank 15 via a return line 18, which turns into return line 14. The mouths 17*a* and 18*a* of lines 17 and 18 are arranged such that they are connected to each other via a circumferential groove 3*c* between piston collars 3*a* and 3*b*, when percussion piston 3 is in the impact position (indicated in FIG. 1). As a result of this mutual assignment, control surface SF is at that moment relieved of pressure via control line 17, circumferential groove 3*c* and return line 18.

When percussion piston 3 performs the return stroke, meaning it moves upward in the illustration according to FIG. 1, the connection between the lines 17 and 18 is initially interrupted by piston collar 3*b*, before this collar finally frees mouth 17*a* once more and by doing so establishes a connection between lines 17 and 5 via front cylinder chamber segment 2*b*. As a result of this connection, control surface SF is now admitted with the working pressure generated by is hydraulic pump 6.

Based on the previously described design, the percussion tool 1 operates as follows:

As soon as lines 5 and 17 are connected via front cylinder chamber segment 2*b*, during the return stroke of percussion piston 3 (counter to the working stroke movement according to arrow 3*e*), control valve 9 moves under the effect of control surface SF, admitted with working pressure, into the working stroke position shown in FIG. 2*a*. As a result of this, the connection between cross bore 11 and discharge line 12 is interrupted, while supply line 10 and rear cylinder chamber segment 2*a* are connected via the freed mouth 10*a*. Accordingly, the working pressure is now also present at the larger piston area A2 as well, so that percussion piston 3, counter to the reset force originating with smaller piston area A1, starts to perform a working stroke movement in the direction of arrow 3*e*. During the working stroke movement, fluid pumped by hydraulic pump 6 as well as fluid that is displaced from first cylinder chamber segment 3*b* flows into rear cylinder chamber segment 2*a*.

Shortly before percussion piston 3 impacts with chisel 4 via its piston tip 3*d*, the previously mentioned connection between control line 17 and return line 18 is made via circumferential groove 3*c*, resulting in a relief of pressure for control surface SF. The high pressure existing in the rear cylinder chamber segment 2*a* now acts upon a total effective surface resulting from a difference in size between larger valve face S2 and smaller valve face S1, and accordingly moves control valve 9 (downward in the illustration according to FIG. 1) in the direction of the return stroke position shown in FIG. 2*b*, in which control valve 9 supports itself via its smaller face S1 on front stop face 2*c* of working cylinder 2. In this return stroke position, mouth 10*a* of supply line 10 is interrupted by a portion of control valve 9 extending toward valve face S1 while cylinder chamber segment 2*a* is connected to discharge line 12 via cross bore 11 and mouth 12*a*. Since the fluid in rear cylinder chamber segment 2*a* is pushed out counter to the flow resistance generated by screen 13, rear cylinder chamber segment 2*a* is under increased pressure, as a result of which control valve 9 is held during the complete return stroke of percussion piston 3 in the return stroke position shown in FIG. 2*b*.

Figure 3:
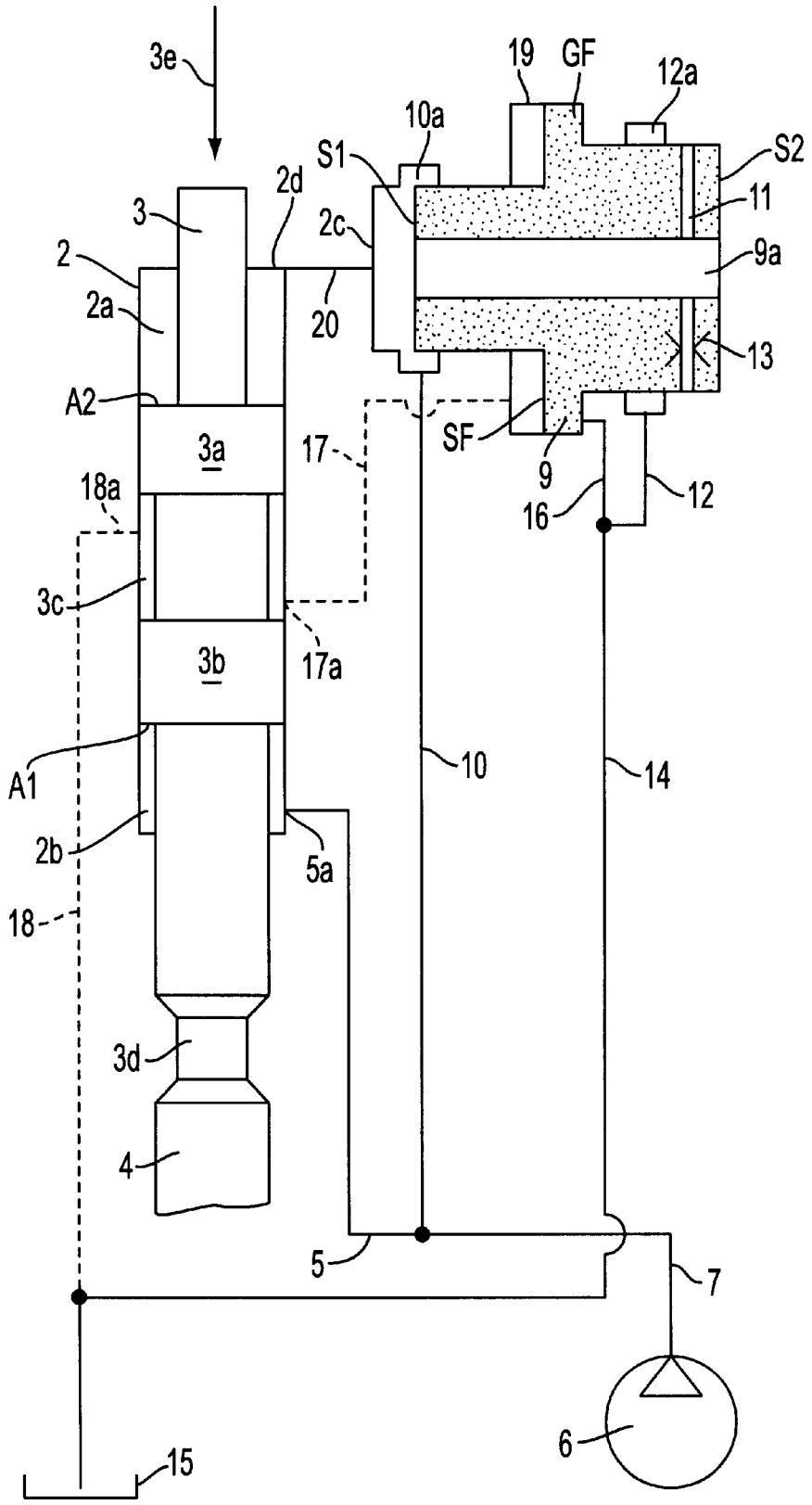
FIG. 3 is a schematic showing a partial side view of a percussion tool according to another embodiment of the invention, for which the control is arranged separate from the working cylinder.

Differing from the previously described embodiment according to FIGS. 1, 2*a*, and 2*b*, percussion tool 1 can also have a control 8 which is arranged as a separately working cylinder 2, as shown in FIG. 3.

Control valve 9 in this case is held axially movable in its own control housing 19, wherein its hollow space 9*a* is connected via a line 20, located near rear stop face 2*d* (compare also FIGS. 1, 2*a*, and 2*b*), to rear cylinder chamber segment 2*a*.

Within the framework of the invention, control 8 can also be designed such that the flow resistance is integrated into the control valve 9. This can be realized simply in that screen 13, as shown in FIG. 3, is installed in cross bore 11. With this embodiment, discharge line 12 accordingly does not have a specially designed, additional flow resistance.

Of course, the embodiment according to FIGS. 1, 2*a*, and 2*b* can be designed accordingly within the framework of the invention, meaning it can have a control 8, for which the flow resistance is not a component of discharge line 12, but is integrated into control valve 9.

Figure 4:
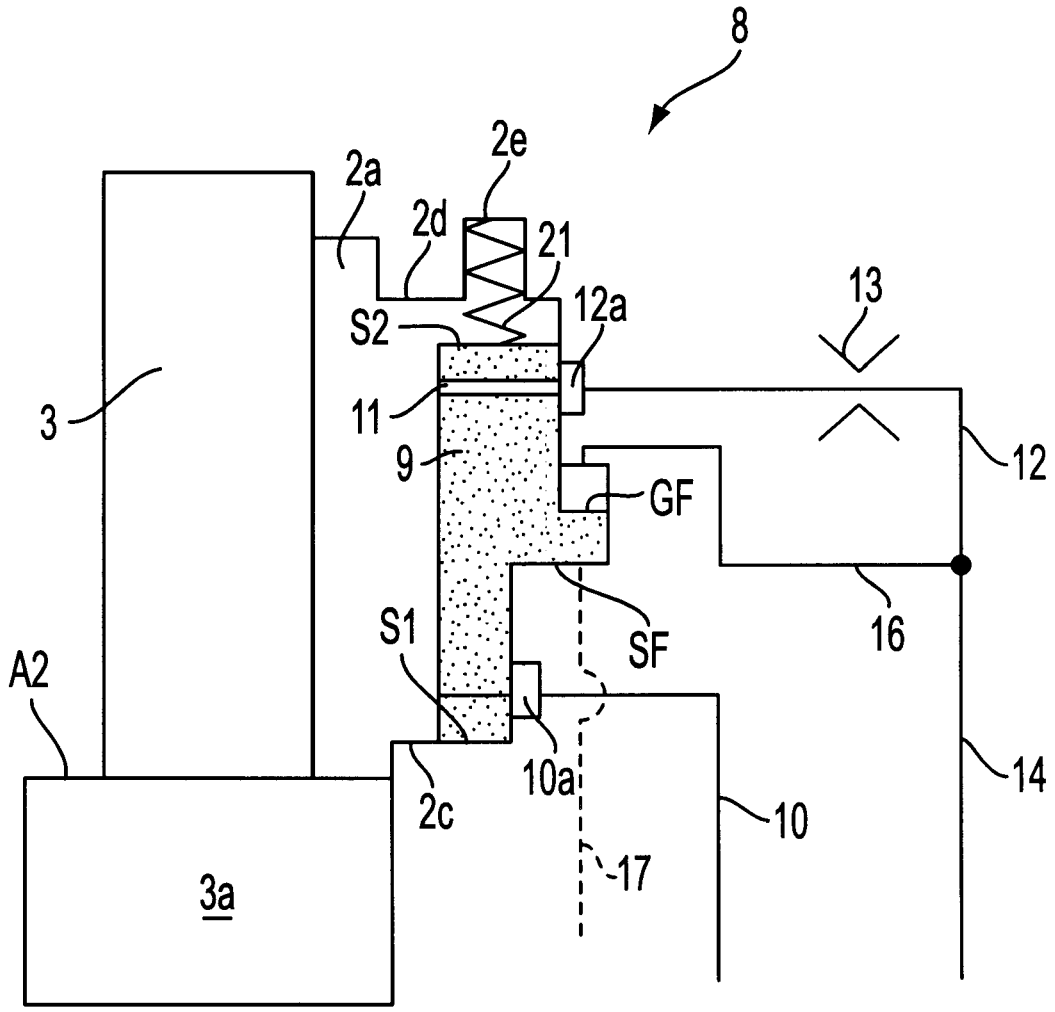
FIG. 4 is a partial side view of a control valve region of a percussion tool with an additional mechanical reset that is effective in the direction of the return stroke position.

As shown in FIG. 4, control 8 can additionally be provided with a mechanical reset, preferably in the form of a spring unit 21, which aids in the reversal of control valve 9 in the direction of the return stroke position. For this purpose, spring unit 21 can be arranged and designed so way that it acts upon larger face S2 and/or counter surface GF. For the embodiment shown in FIG. 4, control valve 9 supports itself via its larger face S2 on a prestressed spring unit 21, which itself is arranged in a projecting recess 2*e* of rear stop face 2*d*. Under the effect of this mechanical reset, control valve 9 has the tendency to resume the illustrated return position.

The advantage achieved with the invention consists in that the required switching between working stroke and return stroke can be realized with simple means and without mechanical pulling along by the percussion piston, wherein the control can also be integrated, if necessary, into the already existing working cylinder. The suggested new percussion tool design additionally does not need a double fitting in the sense of the initially mentioned state of the technology, since the control valve is supported only with its outside surface on the surrounding area.

The invention has been described in detail with respect to preferred embodiments, and it will now be apparent from the foregoing to those skilled in the art that changes and modifications may be made without departing from the invention in its broader aspects, and the invention, therefore, as defined in the appended claims is intended to cover all such changes and modifications as fall within the true spirit of the invention.

What is claimed is:

1. A fluid-powered percussion tool, comprising:

a working cylinder having a front cylinder chamber segment and a rear cylinder chamber segment;

a percussion piston having opposite ends and movable within the working cylinder in one direction during a working stroke for impacting a tool at one of the opposite ends of the percussion piston and movable in an opposite direction during a return stroke, the percussion piston including a first piston area effective in the return stroke direction, delimiting the front cylinder chamber segment and being constantly connected to a pressure line connected to a source of fluid pressure, the percussion piston further including a second piston area, larger than the first piston area, effective in the working stroke direction and delimiting the rear cylinder chamber segment, the percussion piston further including a circumferential groove arranged between the first and second piston areas and being connected to a non-pressurized return line;

a control housing; and a control valve disposed within the control housing and movable relative to the housing between a working stroke position and a return stroke position, the control valve comprising a sleeve defining an interior hollow space in continuous fluid communication with the rear cylinder chamber segment, the control valve presenting first and second valve faces of different areas relative to one another and that are effective in opposite directions to each other, and a control surface which is effective for moving the control valve into its working stroke position and which is alternately coupled by a line to (a) the circumferential groove between the first and second piston areas of the percussion piston for communicating with the return line and (b) to the front cylinder chamber segment for communicating with the pressure line, the rear cylinder chamber segment being placed in communication with one of the pressure line and the return line in dependence of the position of the control valve and thereby subjecting the larger second piston area to a changeable pressure, the control valve presenting a total effective surface, comprising a difference in the area between the first and second valve faces, which is under a pressure that is proportional to the changeable pressure on the larger second piston area delimiting the rear cylinder chamber segment, wherein when the percussion piston approaches an upper dead center position during the return stroke, the control surface of the control valve is connected to the pressure line via the front cylinder chamber segment and switches into the working stroke position for connecting the rear cylinder chamber segment with the pressure line, and when the percussion piston approaches a point of impact during the working stroke, the control surface of the control valve is coupled to the return line via the circumferential groove of the percussion piston to relieve pressure at the control surface and the control valve is switched to the return stroke position due to the pressure in the rear cylinder chamber segment, thereby interrupting the connection of the rear cylinder chamber segment with the pressure line and connecting the rear cylinder chamber segment with a discharge line, which is connected to the return line via a flow resistance for discharging the rear cylinder segment against the flow resistance.

2. The device according to claim 1, wherein the control valve additionally includes a mechanical reset that is effective for moving the control valve into its return stroke position.

3. The device according to claim 1, wherein the control surface, as seen in a cross section, is formed on a projection pointing radially outward in a shape of a collar, the collar presenting a counter surface which is kept non-pressurized by a connection to the return line.

4. The device according to claim 1, wherein a larger one of the first and second valve faces and the control surface are oriented in opposite directions.

5. The device according to claim 1, wherein the control valve includes a cross bore for connecting the rear cylinder chamber segment with the discharge line.

6. The device according to claim 5, wherein one of the cross bore and the discharge line include the flow resistance.

7. The device according to claim 5, wherein the cross bore is arranged near the larger valve face.

8. The device according to claim 1, wherein the rear cylinder chamber segment includes a ring-groove presenting a mouth into which the pressure line opens, and in the return stroke position of the control valve, the mouth of the ring-groove is closed off by a portion of the control valve which is adjacent the smaller valve face.

9. The device according to claim 1, wherein the control valve is arranged in the rear cylinder chamber segment, coaxial to a longitudinal axis of the working cylinder.

10. The device according to claim 1, wherein the flow resistance comprises a screen.

* * * * *